US005112237A

United States Patent [19]

Yang

[11] Patent Number: 5,112,237

[45] Date of Patent: May 12, 1992

[54] SAFETY PLUG RECEPTACLE

[76] Inventor: Chung-Chieh Yang, Bo.21, Pa-Dah Road, Chia-An Village, Lung-Tan, Taiwan

[21] Appl. No.: 680,887

[22] Filed: Apr. 5, 1991

[51] Int. Cl.[5] ..... H01R 29/00

[52] U.S. Cl. ..... 439/188; 200/51.09; 200/51.10; 200/317; 439/490

[58] Field of Search ..... 439/188, 488–490, 439/620–622, 924, 511; 200/51.09, 51.10, 317, 534, 535

[56] References Cited

U.S. PATENT DOCUMENTS

| | | | |
|---|---|---|---|
| 3,119,046 | 1/1964 | Usher | 200/317 |
| 3,924,914 | 12/1975 | Banner | 439/490 |
| 4,052,580 | 10/1977 | Stanish | 200/535 |
| 4,148,536 | 4/1979 | Petropoulsos et al. | 439/188 |
| 4,191,871 | 3/1980 | Coyle | 200/317 |
| 4,230,386 | 10/1980 | Farnworth et al. | 439/188 |
| 4,283,102 | 8/1981 | Richier | 439/188 |
| 4,853,823 | 8/1989 | Arechavaleta et al. | 200/51.09 |

*Primary Examiner*—Paula A. Bradley

*Attorney, Agent, or Firm*—Lowe, Price, LeBlanc & Becker

[57] ABSTRACT

A safety plug receptacle, comprising a shuttle means controlled by the plug which is inserted therein to connect the two conductive clamps therein, which are provided for connecting the two plug pins of said plug, to an external power supply. Removal of the plug causes the shuttle means to disconnect the two conductive clamps. Indicator lamp is mounted on the casing of the plug receptacle to give light when the two conductive clamps are connected. Hook means are respectively attached to the two conductive clamps for hooking plug pins in position. Socket means is set to isolate the two conductive clamps from each other so as to eliminate possible short circuit problem.

5 Claims, 6 Drawing Sheets

SAFETY PLUG RECEPTACLE

BACKGROUND OF THE INVENTION

The present invention relates to plug receptacles and relates more particularly to a safety plug receptacle which is so arranged that electric power is connected only when a plug is inserted therein.

Electric plug and receptacle are provided for connecting electric power supply to an electric appliance to drive it to operate. After having been used for a certain length of time, the connection between the conductive spring plates of a receptacle and the plug pins of a plug may be loosened easily causing contact failure or electric leakage. Because the conductive spring plates of a receptacle which is connected to an electric power supply are electrically energized, it is very dangerous when touched by a conductive object. Therefore, casualty from electric shock may happen easily among young children who try to use things to detect the inside of a receptacle due to curiosity. Further, when an electric appliance is out of work, it is very difficult to ordinary people to identify if an electric appliance is damaged or power supply is disconnected due to damage of plug or receptacle. Besides the above problems, it is very difficult to insert a plug in a receptacle in dark condition.

SUMMARY OF THE INVENTION

The present invention has been accomplished to eliminate the aforesaid problems. It is therefore an object of the present invention to provide a plug receptacle for connecting power supply which is electrically connected only when a plug is inserted therein. It is another object of the present invention to provide a plug receptacle which has an indicator means to automatically give light when the two conductive clamps which are provided for connecting the two plug pins of the plug which is inserted therein are electrically connected. It is still another object of the present invention to provide a safety plug receptacle which has a means to separate the two conductive clamps and parts with different poles of power therein from each other so as to eliminate possible short circuit problem. It is a yet further object of the present invention to provide a plug receptacle which has means to firmly retain the plug, which is inserted therein, in a connected position.

DETAILED DESCRIPTION OF THE PREFERRED EMBODIMENT

Figure 1:
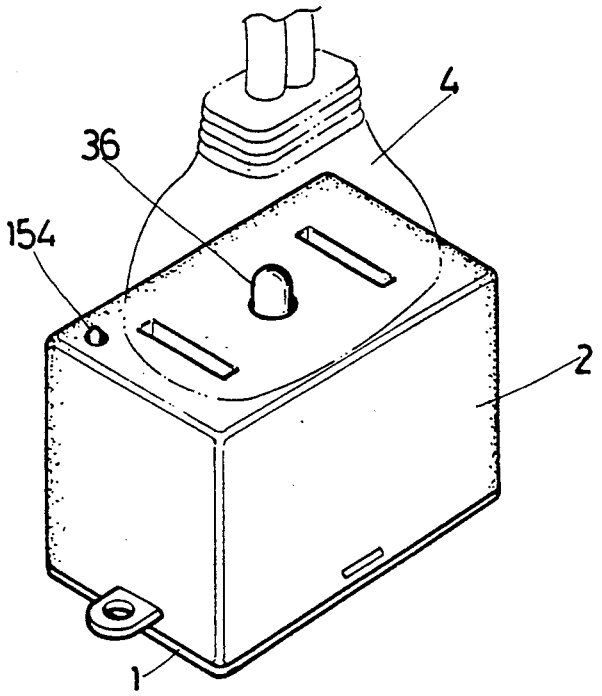
FIG. 1 illustrates the preferred embodiment of the safety plug receptacle of the present invention.
Figure 2:
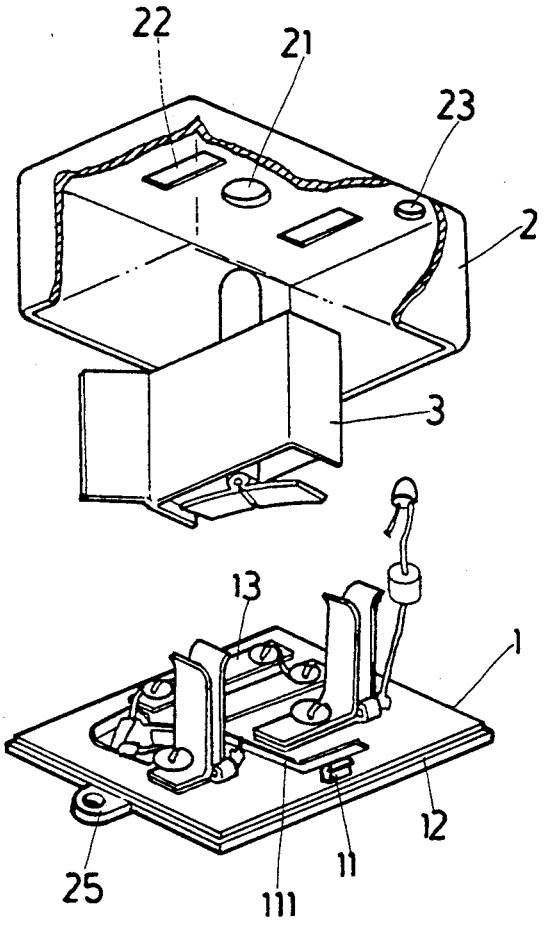
FIG. 2 is a perspective dismantled view thereof.
Figure 3:
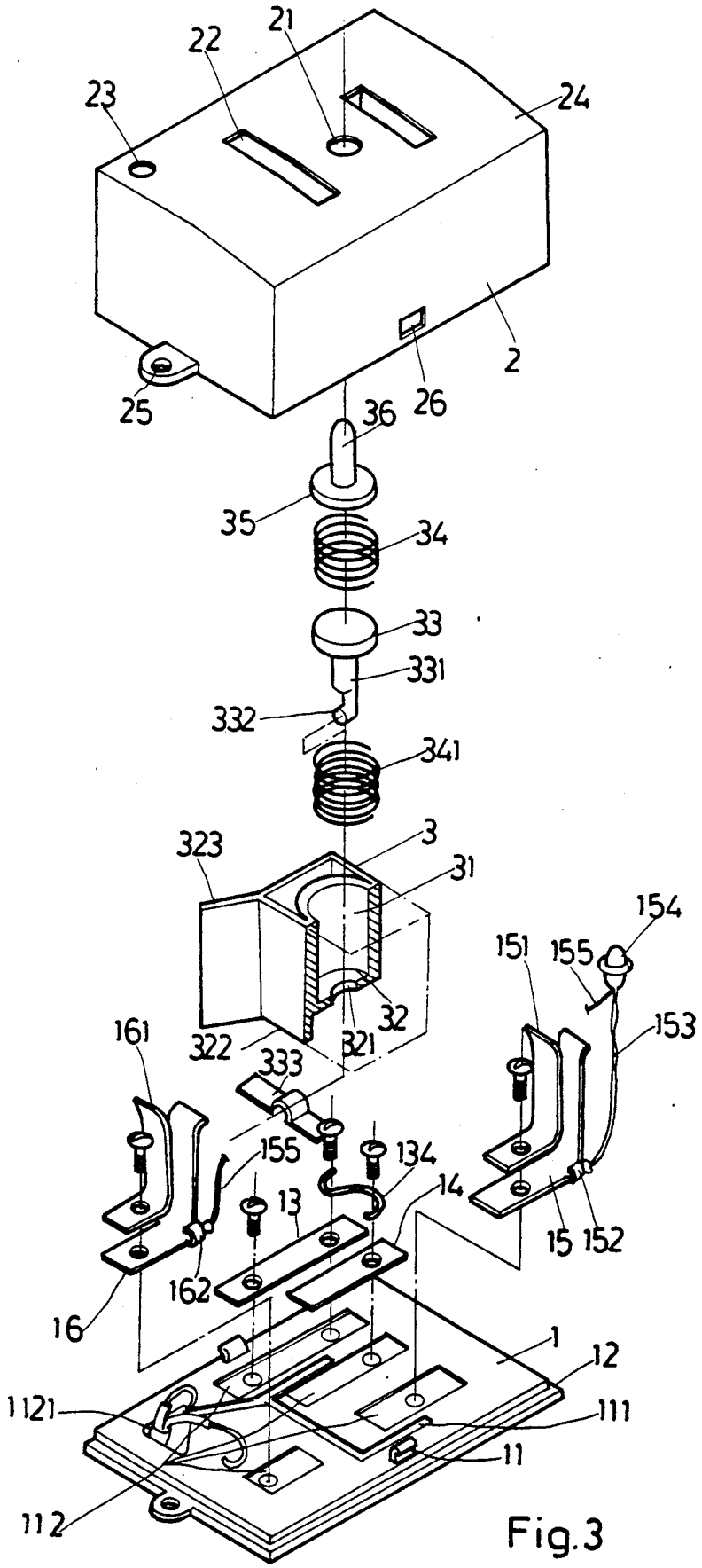
FIG. 3 is a perspective exploded view thereof.

Referring to FIGS. 1, 2 and 3, there is illustrated a plug receptacle in accordance with the present invention, having a base plate 1 covered with a cover 2 to hold a socket means 3 therein. Cover 2 is designed in a case-like structure, having connecting plates 25 for connecting cover 2 and base plate 1, a center hole 21 at the center of the top face thereof, two plug holes 22 on the top face thereof at two opposite sides relative to said center hole 21 for inserting plug pins, and a LED hole 23 at the top face thereof in one corner for mounting a LED or indicator lamp. The top face of the cover 2 includes a sloping surface portion 24 at one side. The purpose of this sloping surface portion 24 will be described further. Base plate 1 has a stepped edge 12 around the periphery thereof for mounting the cover 2 in a flush manner and a plurality of recesses 111 and 112 at the top for mounting two conductive plates 13 and 14 and two conductive clamps 15 and 16 and sockett projections 322 and 323, wherein conductive clamps 15 and 16 are each comprised of two clamping elements 151 or 161 respectively connected together by a fastening means 152 or 162; an extra conductive plate 14 is provided to control the connection between conductive plate 13 which is connected to electric power supply and conductive clamp 15 which is provided for output of electric current. A fuse 134 is connected between the two conductive plates 13 and 14 for protecting against a power surge. The two conductive clamps 15 and 16 have each a conductor 153 or 155 respectively connected to a light emitting diode (indicator lamp) 154. Socket means 3 is comprised of a square casing having a cylindrical chamber 31 at the center which has a through-hole 321 at the center of the flat bottom surface 32 thereof. The square casing of the socket means 3 has a side projection 323 incorporating into a bottom projection 322. By engaging the bottom and side projections 322 and 323 into the recess 111, the socket means 3 is fastened in the base plate 1 to separate positive parts from negative parts such as power lines 1121 from conductive plates 13 and 14 and conductive clamps 15 and 16. Shuttle means 33 and 36 are respectively fastened in the cylindrical chamber 31 of the socket means 3 at two opposite ends. The lower shuttle means 33 has a bottom rod 331 which has a hooked end 332 mounted with a conductivity bridge 333 which is connected between the conductive plate 14 and the upper clamping element 151 of the conductive clamp 15. The upper shuttle means 36 has a top rod inserted through the center hole 21 to protrude over the cover 2. There are provided two spring coils 34 and 341, wherein one spring coil 34 is set between the upper and lower shuttle means 36 and 33, the other spring coil 341 is set below the lower shuttle means 33.

Figure 4:
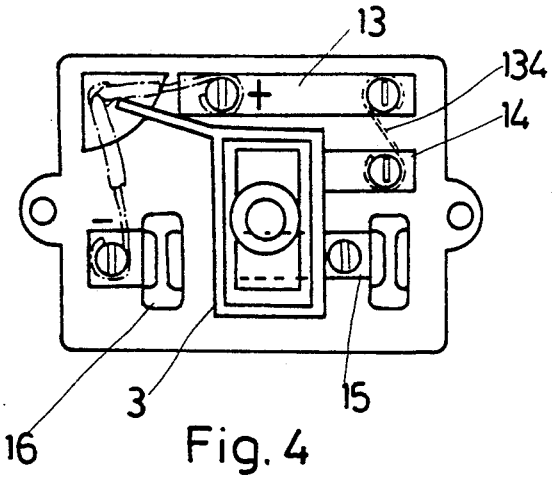
FIG. 4 is a front top view thereof.
Figure 5:
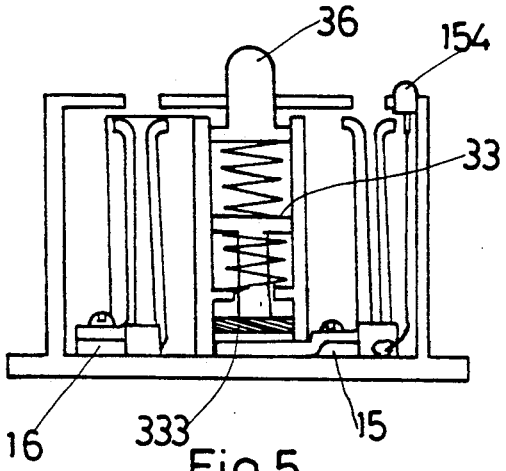
FIG. 5 is a sectional elevational view thereof.
Figure 6:
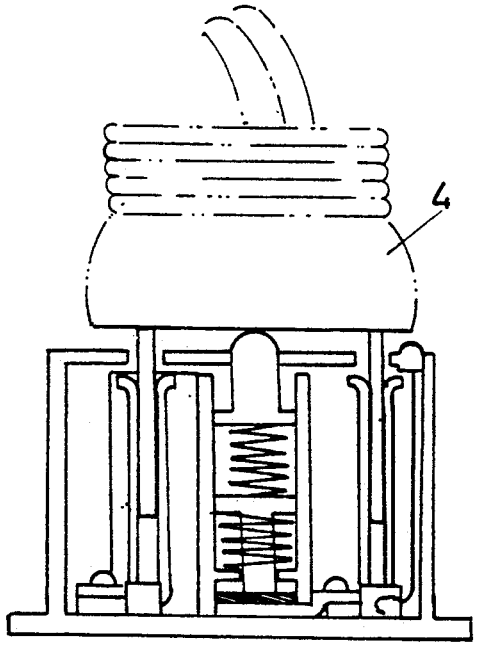
FIG. 6 is a schematic sectional view showing the connection of a plug therein.

Referring to FIGS. 4, 5 and 6, when plug 4 is inserted in the cover 2, the upper shuttle means 36 is forced to squeeze the lower shuttle means 33 causing the conductivity bridge 333 to connect conductive plate 14 and the conductive clamp 15. When the conductive clamp 15 is electrically connected by the conductivity bridge 333, the light emitting diode 154 is simultaneously turned on to emit light. As soon as plug 4 is removed from the cover 2, electric power supply is immediately disconnected. The arrangement of the spring coils 34 and 341 is to produce a spring force to automatically push the upper shuttle means 36 to protrude beyond the cover 2 and, simultaneously serving as a buffer means to protect the shuttle means and the conductivity bridge from damage.

Figure 7:
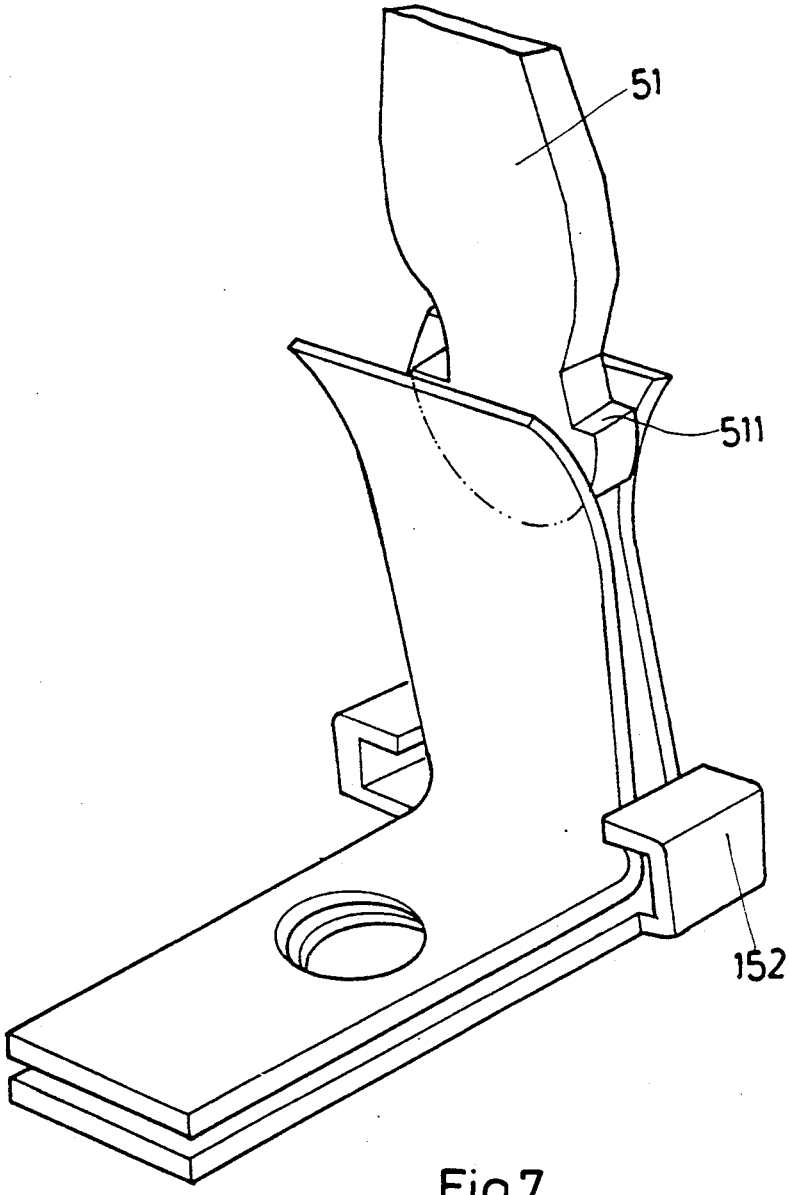
FIG. 7 is a schematic drawing in enlarged scale showing the relative positioning of a plug pin with a hook means.
Figure 8:
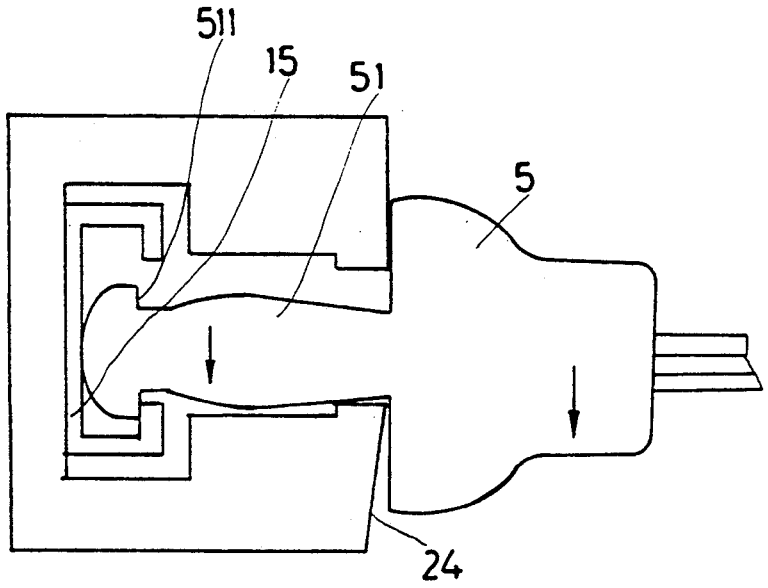
FIG. 8 illustrates a installation example according to the present invention in which the plug is vertically secured in the receptacle.
Figure 9:
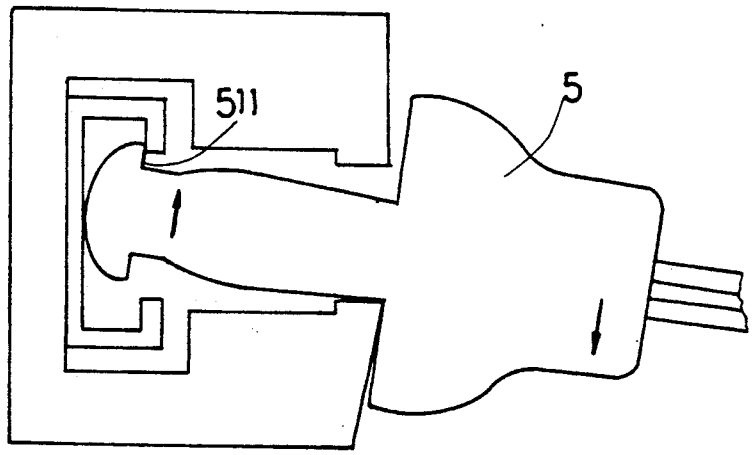
FIG. 9 illustrates another installation example in which the plug is obliquely secured in the receptacle.

Referring to FIGS. 7, 8 and 9, plug pins 51 of appliance plug 5 may be disposed after plugging in a vertical position relative to the plug holes 22 of the cover 2 engaged with hooked end 511 of each plug pin 51 firmly engaged with the fastening means 152 or 162 of the conductive clamp 15 or 16 (as shown in FIG. 8) when a fixed type of electric appliance, such as refrigerator and etc., is to be connected obliquely against the sloping surface 24 of the cover 2 inserted in the plug holes 22 of the cover 2 with the hooked end 511 of each plug pin 51 slightly hooked in the fastening means 152 or 162 of the conductive clamp 15 or 16 when a movable type of electric appliance, such as electric fan, cassette radio and etc., is to be connected.

However, for the common plug which do not have hooked pins can be still used in this invention but no function of fastening only.

What is claimed is:

1. A safety plug receptacle of the type comprising a base plate covered with a cover, said base plate having a first conductive clamp connected to a first conductive plate, said first conductive plate being connected to a positive terminal of an external power supply, and a second conductive clamp connected to a negative terminal of said external power supply, said cover having two plug holes respectively disposed in alignment with said first and second conductive clamps, the improvement comprising:

a second conductive plate mounted on said base plate and connected to said first conductive plate via a fuse;

a socket means made from non-conductive material, mounted on said base plate, defining therein a hollow space, said hollow space being divided by a division board into an upper receiving chamber and a lower receiving chamber;

a shuttle means made from non-conductive material, set in said upper receiving chamber and supported by a spring means, said shuttle means comprising an upper segment having an extension projecting over said cover and a lower segment having a hooked end extending into said lower receiving chamber;

a conductivity bridge secured to the hooked end of the lower segment of said shuttle means;

an indicator lamp mounted on said cover, having two terminals respectively connected to said first and second conductive clamps; and wherein inserting the two plug pins of an appliance plug in said first and second conductive clamps through said two plug holes causes said shuttle means to force said conductivity bridge to electrically connect said second conductive plate to said first conductive clamp forming with said second conductive clamp and said external power supply a closed circuit, releasing of said appliance plug from said first and second conductive clamps causes said shuttle means to be moved upwards by said spring means to separate said conductivity bridge from said second conductive plate and said first conductive clamp and simultaneously to disconnect said first conductive clamp from said external power supply.

2. The safety plug receptacle of claim 1, wherein said indicator lamp is comprised of at least a light emitting diode which is triggered to emit light when said shuttle means is pressed down to force said conductivity bridge to connect said second conductive clamp to said first conductive clamp via said second and first conductive plates.

3. The safety plug receptacle of claim 1, wherein said socket means is mounted on said base plate to give a guide way at the inside to guide said shuttle means to move in a fixed direction, and to separate all the parts in the receptacle into isolated spaces, in which said positive and negative terminals from external power supply, said first conductive clamp, said first conductive plate, said second conductive clamp and said second conductive plate are all separate from one another.

4. The safety plug receptacle of claim 1, wherein said two plug pins of said appliance plug have each a hooked end; said first and second conductive clamps are each comprised of two conductive clamping elements secured together by a fastening means, said hooked end having two hooked portions at two opposite ends for hooking said hooked end of said plug pins in position.

5. The safety plug receptacle of claim 1, wherein said cover has at least one half of the topmost edge formed into a sloping surface.

* * * * *